US005740257A

United States Patent [19]

Marcus

[11] Patent Number: 5,740,257

[45] Date of Patent: Apr. 14, 1998

[54] ACTIVE NOISE CONTROL EARPIECE BEING COMPATIBLE WITH MAGNETIC COUPLED HEARING AIDS

[75] Inventor: Larry Allen Marcus, Hamilton County, Ind.

[73] Assignee: Lucent Technologies Inc., Murray Hill, N.J.

[21] Appl. No.: 769,985

[22] Filed: Dec. 19, 1996

[51] Int. Cl.[6] ..... H04R 25/00

[52] U.S. Cl. ..... 381/71.6; 381/68; 381/68.6; 381/68.5; 381/71.1; 379/52; 379/443; 379/444

[58] Field of Search ..... 381/71.1, 72, 163, 381/71.6, 68, 68.6, 68.5; 379/52, 443, 444

[56] References Cited

U.S. PATENT DOCUMENTS

| | | | |
|---|---|---|---|
| 3,322,897 | 5/1967 | Vozeolas et al. | 379/443 |
| 3,396,245 | 8/1968 | Flygstad | 379/52 |
| 4,697,283 | 9/1987 | Lafrance et al. | 379/443 |
| 5,010,575 | 4/1991 | Marutake et al. | 379/52 |
| 5,086,464 | 2/1992 | Groppe | 379/52 |
| 5,134,659 | 7/1992 | Moseley | 381/72 |
| 5,557,673 | 9/1996 | Ginzburg | 381/68 |

OTHER PUBLICATIONS

"Coupling Hearing Aids To Telephone Sets", Malaga–Torremalinos, ITU Telecommunication Standardization Sector Recommendation p. 37.

Headset with Active Noise–Reduction System for Mobile Applications* by Volker Bartels, Engineer Report—presented at the 90th Convention of the Audio Engineering Society, Paris, France, 1991 Feb. 19–22, pp. 277–281, J. Audio Eng. Soc., vol. 40, No. 4, 1992 Apr.

*Primary Examiner*—Sinh Tran

*Attorney, Agent, or Firm*—Thomas Stafford

[57] ABSTRACT

Active noise control for use by individuals using magnetically coupled hearing aids is realized by generating a true representation of the handset input signal, which is employed to drive a separate external field coil. The external field coil is positioned between the handset receiver and the handset acoustic output ports so that it is in close proximity to a user's ear cavity and, hence, to the magnetically coupled hearing aid. Also, in some embodiments of the invention, a magnetic shield is employed between the handset receiver and the external field coil to inhibit the magnetic leakage field from the receiver element from mixing with the magnetic field from the external field coil.

18 Claims, 4 Drawing Sheets

113

111

112

110
RECEIVER
105
HIGH GAIN AND SHAPING
104
GAIN AND SHAPING
201
114
102
103
108
109
107
106
202
203
201

ACTIVE NOISE CONTROL EARPIECE BEING COMPATIBLE WITH MAGNETIC COUPLED HEARING AIDS

TECHNICAL FIELD

This invention relates to active noise control and, more particularly, to the use of active noise control with handsets, headsets or the like that require to have compatibility with magnetically coupled hearing aids.

BACKGROUND OF THE INVENTION

Active noise control (ANC) is employed to cancel incident acoustic ambient noise by forcing the cavity acoustic signal within the ear cavity to follow the original input signal. This is accomplished by using a microphone (called the error microphone) to detect the so-called feedback signal in the ear cavity, which prior to cancellation is the combination of an input signal and any incident acoustic ambient noise, and compare it to the original input signal. The difference passes through control circuitry that provides high gain amplification and, hence, drives the receiver element that produces an ambient noise-free ear cavity signal. Prior arrangements are known which have attempted to minimize the ambient noise that is developed in the ear cavity. See, for example, U.S. Pat. No. 5,134,659, issued to Moseley, and an article entitled "Headset With Active Noise Reduction System for Mobile Applications", *Journal of the Audio Engineering Society*, Vol. 40, No. 4, Apr. 1992. Unfortunately, when these prior art noise canceling arrangements are used with telecommunications handsets that are required by law (U.S. Public law 100–394, Aug. 16, 1988) to be compatible with magnetically coupled hearing aids, (i.e., the hearing aid coil, a so-called telecoil, detects the leakage magnetic field of the handset receiver element and amplifies it within the hearing aid to provide the needed signal for hearing aid operation, independent of the pressure in the ear cavity (see Electronic Industries Association specification RS504)), the feedback signal and input signal will produce a leakage magnetic field that, when detected by the hearing aid (usually via a small induction coil), will be extremely noisy to the hearing aid user when used in acoustically noisy areas. Note that the presence of leakage fields from the receiver may result from either the use of certain electromagnetic designs or receivers with non-magnetic designs that use internal field coils. In the latter case, when using a receiver that does not emit a significant magnetic field, an internal field coil is in series or in parallel with the acoustic driving element (typically a piezoelectric bender element or an electret element) but the field generated by the internal coil is still affected by the ANC feedback signal. Thus, a problem still exists in the art requiring a solution when using active noise control in a handset when it is employed by individuals using magnetically coupled hearing aids.

SUMMARY OF THE INVENTION

The problems and limitations of prior handsets employing active noise control for use by individuals using magnetically coupled hearing aids are overcome by generating a true representation of the original input signal, which is employed to drive a separate external field coil. The external field coil is positioned between the handset receiver and the handset acoustic output ports so that it is in close proximity to a user's ear cavity and, hence, to the magnetically coupled hearing aid.

Also, in some embodiments of the invention, a magnetic shield is employed between the handset receiver and the external field coil to inhibit the magnetic leakage field from the receiver element from mixing with the magnetic field from the external field coil.

DETAILED DESCRIPTION

Figures 1A, 1B, 1C, 1D:
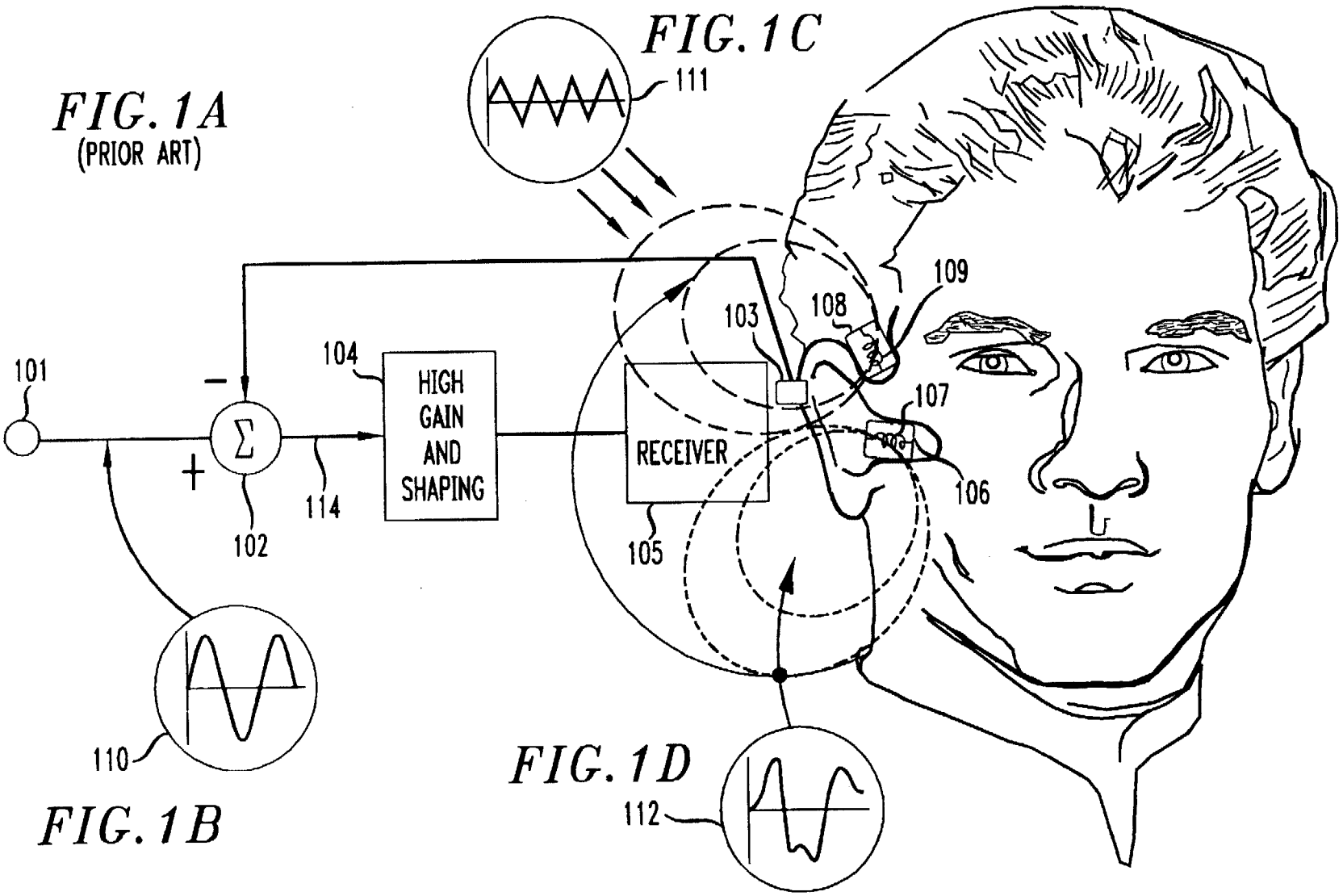
FIG. 1A (PRIOR ART)
FIG. 1A illustrates a prior art active noise control arrangement having active noise control.
FIG. 1B shows a waveform of an incoming signal to be supplied to a receiver.
FIG. 1C shows a waveform of incident acoustic noise.
FIG. 1D shows a waveform of a magnetic field from the receiver and being received at the hearing aid telecoil.

FIG. 1A illustrates in simplified form a schematic of a prior art arrangement for an active noise control circuit and how it would affect users of magnetically coupled hearing aids. Shown is input 101 for receiving an input signal which is supplied to a positive input of algebraic combining unit 102. In this arrangement algebraic combining unit 102 is an algebraic subtractor, which may be implemented in a number of ways. For example, algebraic combining unit 102 may have an inverting input to which the feedback signal is supplied and a noninverting input to which the input signal is supplied. A version of an acoustic signal in the ear cavity picked up by so-called error microphone 103 is supplied to a negative input of algebraic combining unit 102. Preferably, microphone 103 is of a non-magnetic type. The difference signal from unit 102 is supplied to a high gain, control and shaping circuit 104. Circuit 104 is part of the negative feedback ANC approach shown in the analog circuit arrangement of FIG. 1A, and includes a high gain amplifier to allow the resulting ear cavity signal to be dominated by the input signal (a representation of which is shown in FIG. 1B) and yet cancel the incident acoustic noise signal (a representation of which is shown in FIG. 1C) that has entered the ear cavity (entrance of the acoustic ambient noise signal is usually caused by an imperfect seal between the handset earpiece and the user's ear). Other phase and magnitude response control is included to satisfy Nyquist stability criteria. Finally, shaping is added in circuit 104 to provide the desired frequency response for the ear cavity signal. To this end, a drive signal from circuit 104 drives receiver element 105 which, in turn, causes a magnetic field from receiver 105 that is received at the hearing aid inductance coil (telecoil) 107 or 109 (an example of this magnetic field is shown in the waveform of FIG. 1D).

Unfortunately, many users of telecommunications products are hearing impaired and rely on hearing aids that are "magnetically coupled." That is, the hearing aid circuitry has the capability of switching from using the hearing aid's microphone to using a small inductance coil (the "telecoil") to detect the AC leakage magnetic field from receivers. This is called the M/T or microphone/telecoil switch. If the prior art of FIG. 1A is used, it can be understood that the leakage magnetic field of the receiver element will contain a large amount of unwanted signal which is the negative image of the ambient acoustic noise at the telecoil 107 or 108. In FIG. 1A, example waveforms of the input signal 110 (FIG. 1B) (which is desired to be faithfully reproduced), the incident acoustic ambient noise signal 111 (FIG. 1C) (which is desired to be removed from the signal picked up by the hearing aid telecoil 107 or 109) and the magnetic field signals 112 (FIG. 1D) are shown at the respective physical or electrical points where they may be located. The example input signal 110 is shown as a sine wave and the incident acoustic ambient noise signal 111 is shown as a so-called triangular wave for demonstration purposes. The derived sum signal in 114 present in the receiver's leakage field, is shown as a graphical summation of the field due to the example input signal 110 and the example anti-noise signal in 112 produced by the acoustic ANC system. Therefore, this will be extremely objectionable to users of magnetically coupled hearing aids. An arrangement to avoid this is needed. No discussion or means of providing magnetically coupled hearing aid compatibility (as required by US Public Law 100–394, ITU-T Recommendation P.37, any other world standards or any other nation's statutes) with active noise control is known.

Figures 2A, 2B, 2C, 2D, 2E:
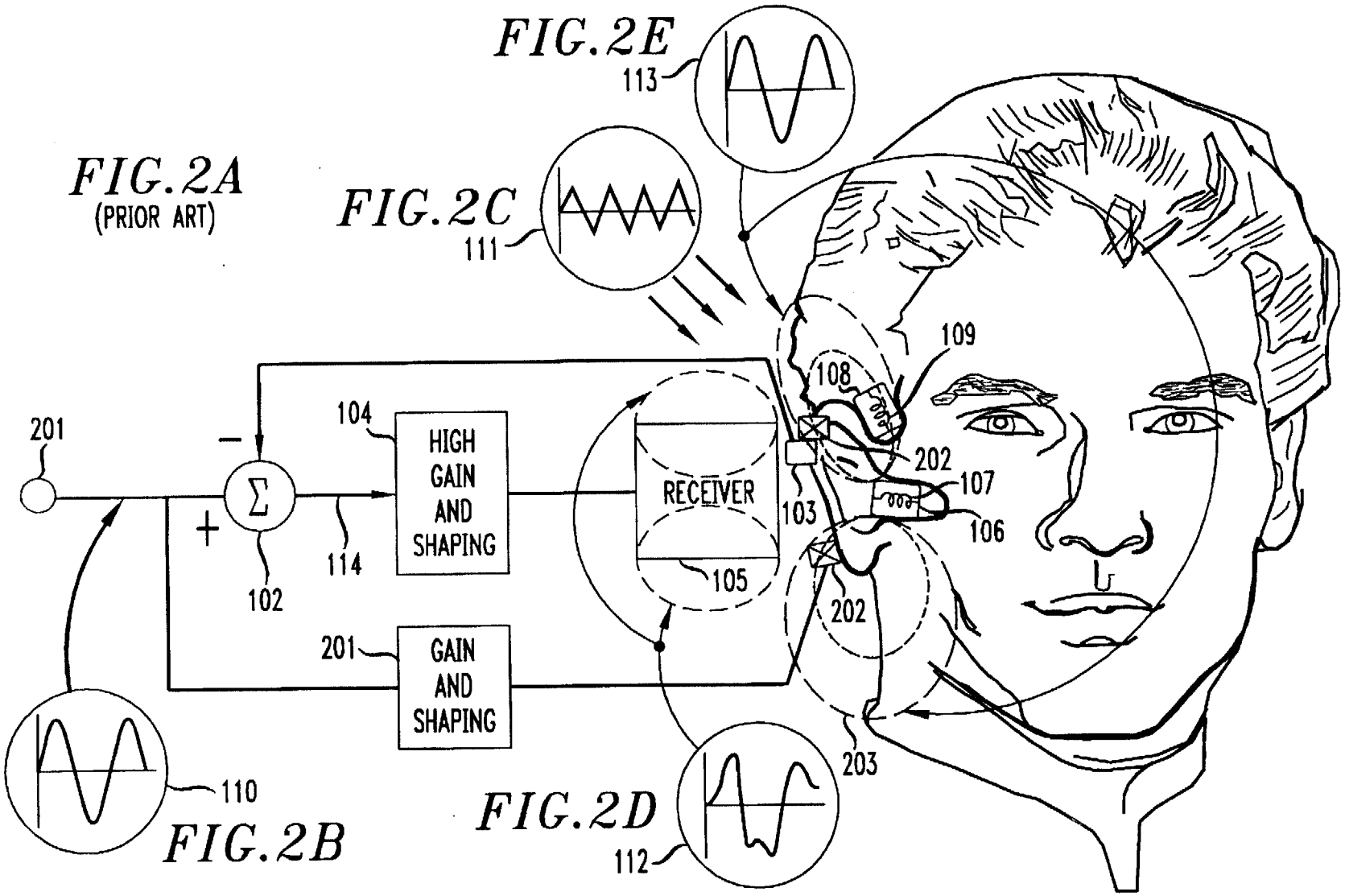
FIG.2A (PRIOR ART)
FIG. 2A illustrates an active noise control arrangement to be utilized by users employing magnetically coupled hearing aids, which includes an embodiment of the invention.
FIG. 2B shows a waveform of an incoming signal to be supplied to a receiver.
FIG. 2C shows a waveform of incident acoustic noise.
FIG. 2D shows a waveform of a magnetic field from the receiver and being received at the hearing aid telecoil.
FIG. 2E shows a waveform of a magnetic field from a hearing aid field coil which is being employed in accordance with the invention.

FIG. 2A illustrates an active noise control arrangement, to be utilized with users employing magnetically coupled hearing aids, which includes an embodiment of the invention. Shown is input signal 201 for receiving an input signal (a representation of which is shown in FIG. 2B) which is supplied to a positive input of algebraic combining unit 102, which in this example is essentially identical to that shown in FIG. 1A. A version of an acoustic signal in the ear cavity (a representation of which is shown in FIG. 2B) picked up by error microphone 103 is supplied to a negative input of algebraic combining unit 102. Preferably, error microphone 103 is of a non-magnetic type. The difference signal from unit 102 is supplied to high gain control and shaping circuit 104. Circuit 104 is part of the negative feedback ANC approach shown in the analog circuit arrangement of FIG. 2A, and includes a high gain amplifier to allow the resulting ear cavity signal to be dominated by the input signal and yet cancel the incident acoustic noise signal that has entered the ear cavity (entrance of the acoustic ambient noise signal is usually caused by an imperfect seal between the handset earpiece and the user's ear). Other phase control and magnitude response is included to satisfy Nyquist stability criteria. Finally, shaping is added to provide the desired frequency response of the output acoustic signal from receiver 105 to the ear cavity. To this end, a drive signal from circuit 104 drives receiver element 105. It will be apparent to those skilled in the art how to implement such arrangements, in well known fashion. Also, the input signal is supplied to gain and shaping circuit 201 which adjusts the input signal level and shapes its frequency response to a desired response for driving external field coil 202 to generate a prescribed magnetic field 203 which provides a true representation of the original input signal. As shown, external field coil 202 is positioned in spatial relationship to receiver element 105 so that it is in closer proximity to the user's ear cavity when in use by the user. Preferably, the external field coil 202 is of a so-called air core design of a type known in the art. Although, in this example the external field coil 202 is cylindrical in shape, other shapes could possibly be equally employed. However, it should be noted that the use of external field coil 202 in an ANC arrangement as shown in FIG. 2A is unique. It should be further noted that in the embodiment shown in FIG. 2A, it is assumed that receiver 105 is emitting a leakage magnetic field much lower in magnitude than that of the external field coil 202. Also, FIG. 2A illustrates the relationship of the handset receiver element 105, including an embodiment of the invention, to a user's ear. Also shown are the positioning of magnetically coupled hearing aids 107 or 109 each including a so-called telecoil 106 or 108, respectively. One of the hearing aids (107) called an in-the-canal type is horizontally orientated in the ear canal of the user while the other (108) is a behind the ear type and is positioned behind-the-ear and also includes a so-called telecoil 109. Of course, only one or the other of these hearing aids would be employed by a user. It should also be noted that a hearing aid telecoil could possibly be positioned in other orientations than those shown without impairing the performance of the invention. As indicated above, example waveforms of the input signal 110 (FIG. 2B) (which is desired to be faithfully reproduced), the incident acoustic ambient noise signal 111 (FIG. 2C) (which is desired to be removed from the signal picked up by the hearing aid telecoil 107 or 109) and the magnetic field signals 112 (FIG. 2D) are shown at the respective physical or electrical points where they may be located. The example input signal 110 is shown as a sine wave and the incident acoustic ambient noise signal 111 is shown as a so-called triangular wave for demonstration purposes. The derived sum signal in 114 present in the receiver's leakage field, is shown as a graphical summation of the field due to the example input signal 110 and the example anti-noise signal in 112 produced by the acoustic ANC system. Additionally, the magnetic field produced by employing hearing aid field coil 202 is shown in FIG. 2E.

Figure 3A:
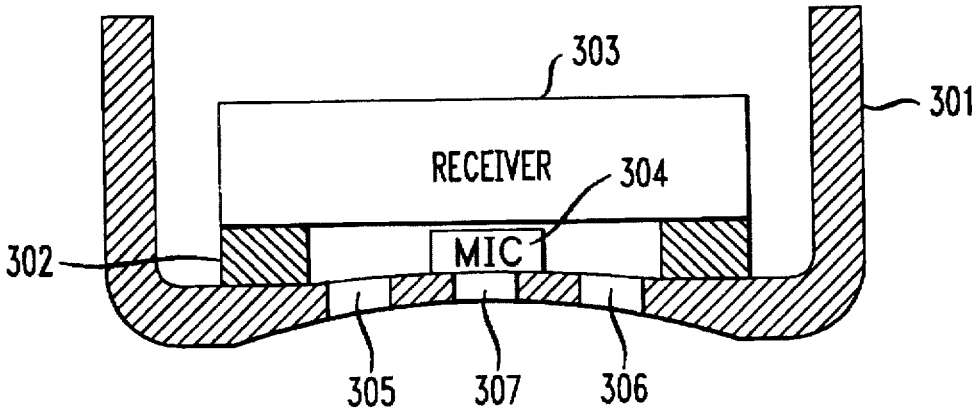
FIG. 3A is a cutaway graphical illustration of a handset receiver element including elements of the invention.
Figure 3B:
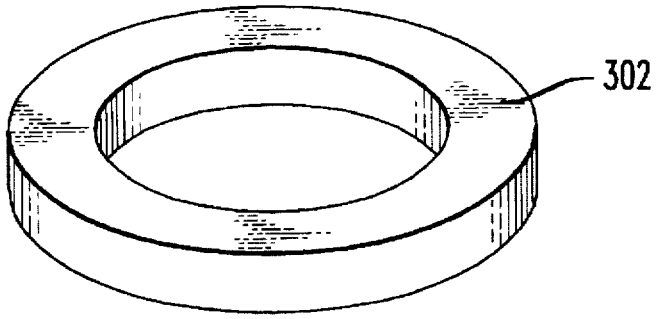
FIG. 3B shows a perspective view of the hearing aid field coil employed in the embodiment of FIG. 3A.

FIG. 3A is a cutaway graphical illustration of a handset receiver apparatus including elements of the invention. FIG. 3A shows an embodiment of the physical location in a typical handset cap 301 (herein shown similar to an AT&T "500" style telephone's "G" handset cap, although handsets or headsets with any exterior style are usable with this embodiment of the invention) of the external field coil 302 in relation to the receiver 303 and error microphone 304. The external field coil 302 is preferably located between the receiver 303 and the handset acoustic ports 305, 306 and 307. The error microphone 304, as is common practice, is located in front of the receiver 303 so that it can sample the acoustic pressure in the customer's ear cavity through error microphone ports 305,306 an 307. The customer's ear, by design, is adjacent to the handset acoustic ports 305,306 and 307. It is observed that any combination of the four necessary parts of this embodiment—the receiver 303, external field coil 302, error microphone 304, and handset cap 301—may be combined in one or more integrated units to facilitate assembly of the handset. FIG. 3B shows a perspective view of field coil 302 of FIG. 3A.

Figure 4A:
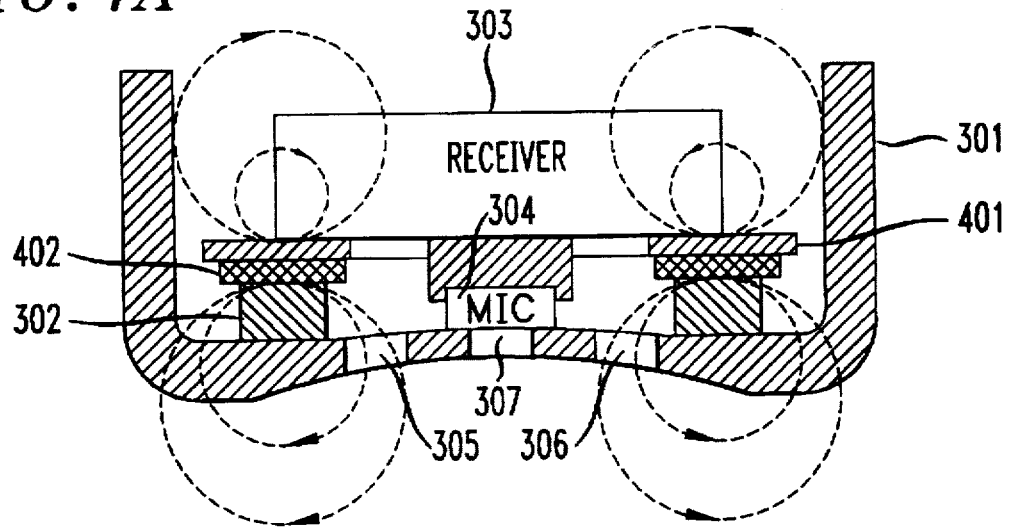
FIG. 4A is a cutaway graphical representation illustrating the positioning of magnetic shields relative to the elements of the handset receiver element employed in another embodiment of the invention.
Figure 4B:
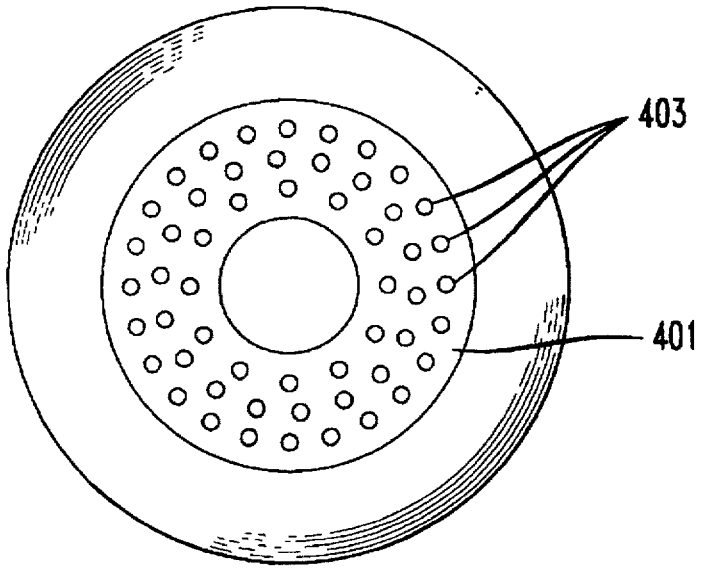
FIG. 4B is a perspective view of the magnetic shield employed in the embodiment of FIG. 4A.
Figure 4C:
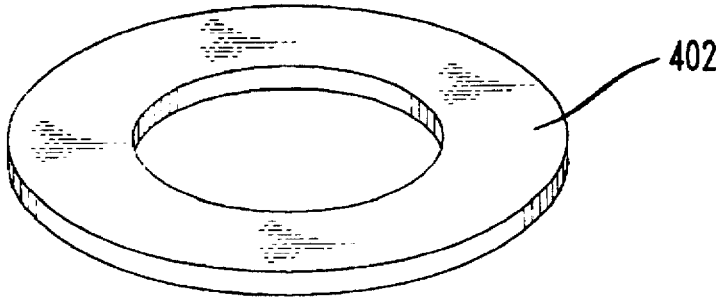
FIG. 4C is a perspective view of a spacer employed in the embodiment of FIG. 4A.

FIG. 4A is a graphical representation illustrating the positioning of permeable magnetic shields 401 relative to the elements of the handset receiver 303 including elements of the invention. FIG. 4A shows a preferred embodiment similar to that shown in FIG. 3A where a magnetically permeable and, preferably, electrically conductive sheet with acoustic ports 305,306 and 307 (called a shield 401) is used to attenuate the magnetic field of the receiver 303 so that it does not interfere with the magnetic field of the external field coil 302. The shield 401 is of a common magnetically permeable material such as mumetal or permalloy. The acoustic ports 403 in shield 401 (FIG. 4B) are, of course, necessary to allow the acoustical function of the receiver 303. The shield 401 in the location shown redirects (or shunts) the receiver's modulated leakage flux away from the telecoils shown in FIG. 2A. The shield 401 also enhances the strength of the desired magnetic field at the telecoils shown in FIG. 2A by closing the magnetic circuit, which is around the external field coil 302, with a low reluctance path. Furthermore, the shield 401 can further isolate the noisy magnetic field of the receiver 303 from the region of the telecoils if it is also electrically conductive. This results from a so-called eddy current skin effect that blocks higher audio frequency magnetic flux from crossing the shield 401. Thus, the shield 401 greatly decreases unwanted magnetic noise resulting from the ANC system and increases the wanted hearing aid field signal. In some cases, an electrically non-conductive spacer 402 may be needed between the external field coil 302 and the shield 401 in order to prevent excessive eddy current blocking of the wanted flux from the external field coil 302 from the region where the telecoils lie. That is, there may be an optimum flux strength at the telecoils achieved by using a spacer 402 of a thickness suitable for a given receiver 303 and external field coil 302 size. It is also noted, as shown in FIG. 4A, that the shield 401 may be used for physical mounting of the error microphone 304, thereby aiding manufacturing and assembly of the handset/headset. Also, as was noted for FIG. 3A, it is observed that any combination of the five necessary parts of this embodiment—the receiver 303, external field coil 302, error microphone 304, shield 401, spacer 402, a perspective view of which is shown in FIG. 4C and handset cap 301—may be combined in one or more integrated units to facilitate manufacturing and assembly of the handset.

It should also be noted that the summation, gain, control and shaping functions shown in FIG. 1, (i.e., components 102 and 104) and in FIG. 2A (i.e., components 102, 104 and 201) may be implemented in digital form, as well as, the analog form shown and discussed above.

Figure 5:
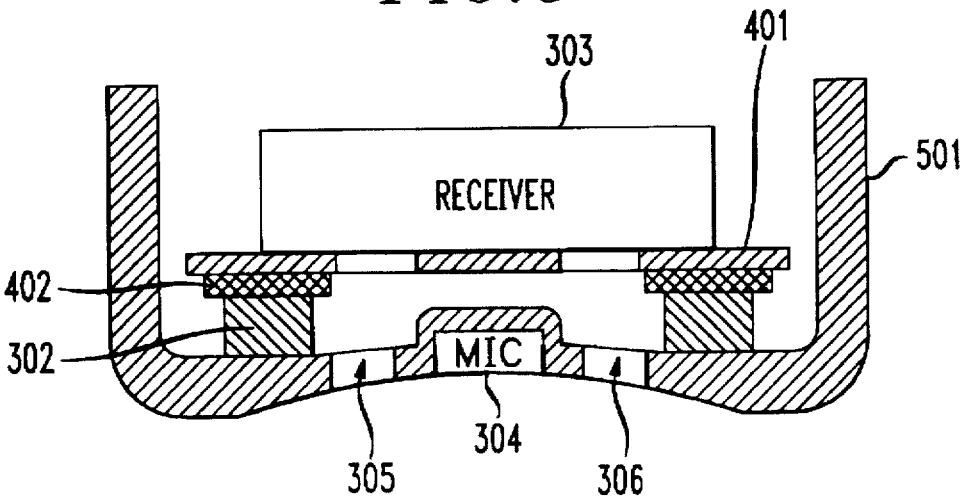
FIG. 5 is a cutaway graphical representation illustrating the positioning of a microphone element relative to the elements of the handset receiver element employed in still another embodiment of the invention.

As shown in FIG. 5, the error microphone element 304 may be externally mounted on the hand set cap 501 so that it may be disposed directly in a user's when is use, instead of communicating with the ear cavity through acoustics ports 305 and 306, as shown in FIG. 4A.

Although the embodiments of the invention have been described as being used primarily with handsets, it will be apparent that they may be equally employed in headset earpieces, including high fidelity headsets and the like.

What is claimed is:

1. Apparatus for use in an active noise control arrangement comprising:

receiver apparatus including an interior cavity and acoustic output ports for emanating sound into an ear cavity;

an input for an input signal;

a receiver element disposed in the interior cavity and being supplied with a first signal for emitting an acoustic signal into the interior cavity;

a transducer arranged so that it will be disposed in the ear cavity when in use or be disposed in the interior cavity for communicating to the ear cavity when in use by an acoustic point for generating a second signal representative of the acoustic signal including any ambient noise signal present in the ear cavity;

an algebraic combining unit for algebraically subtracting the second signal from the input signal to generate a third signal;

modification apparatus for modifying the third signal in a manner to generate the first signal; and a coil arrangement disposed in the interior cavity and being responsive to a modified version of the input signal for generating a magnetic field substantially free of room noise effects, the magnetic field being intended to drive a magnetically coupled hearing aid including a telecoil being employed by a user of the handset, so that reduced acoustic noise coupling is realized to magnetically coupled hearing aids to be employed by users.

2. The apparatus as defined in claim 1 wherein the receiver apparatus is a telephone handset earpiece.

3. The apparatus as defined in claim 1 wherein the receiver apparatus includes a high fidelity headset earpiece.

4. The apparatus as defined in claim 1 wherein two or more components are combined into two or more integrated units so the manufacture of the apparatus is facilitated.

5. The apparatus as defined in claim 1 wherein the coil is an external field coil and is disposed in predetermined spatial relationship in the interior cavity between acoustic output ports of the receiver element and the acoustic output ports of the receiver apparatus.

6. The apparatus as defined in claim 5 wherein the external field coil has a cylindrical shape.

7. The apparatus as defined in claim 5 wherein the transducer is a microphone element and is disposed in predetermined spatial relationship in the interior cavity between the acoustic output ports of the receiver element and the acoustic output port ports of the receiver apparatus and which communicates with the ear cavity via the acoustic point when the apparatus is in use.

8. The apparatus as defined in claim 5 wherein the transducer is a microphone element and is arranged to be disposed in the ear cavity when the apparatus is in use.

9. The apparatus as defined in claim 1 wherein the receiver element may emanate a corrupted magnetic field and further including a shield element for redirecting the corrupted magnetic field from the acoustic output ports of the receiver apparatus, wherein the corrupted magnetic field is effectively shielded from a magnetically coupled hearing aid of a user of the receiver apparatus which is arranged to communicate with the ear cavity of the user when the apparatus is in use.

10. The apparatus as defined in claim 9 wherein the shield element comprises a magnetically permeable and electrically conductive substance.

11. The apparatus as defined in claim 9 wherein two or more components are combined into two or more integrated units so that the manufacture of the apparatus is facilitated.

12. The apparatus as defined in claim 9 wherein the receiver apparatus comprises a telephone handset earpiece.

13. The apparatus as defined in claim 9 wherein the shield element is made of a magnetically permeable substance.

14. The apparatus as defined in claim 13 wherein the receiver element has acoustic output ports and the shield element is disposed in the interior cavity in predetermined spatial relationship between the acoustic output ports of the receiver element and the acoustic output ports of the receiver apparatus.

15. The apparatus as defined in claim 14 wherein the shield element includes acoustic passages therein for passing acoustic signals from the receiver element acoustic output ports to the acoustic output ports of the receiver apparatus.

16. The apparatus as defined in claim 15 wherein the transducer is a microphone element and is disposed in spatial relationship in the interior cavity between the shield element and the acoustic output ports of the receiver apparatus.

17. The apparatus as defined in claim 16 wherein the microphone element is mounted on a surface of the shield element facing the acoustic output ports of the receiver apparatus.

18. The apparatus as defined in claim 16 wherein the microphone element is mounted on the surface of the handset or headset cap and is arranged to communicate directly with the acoustic pressure within the ear cavity when the apparatus is in use.

* * * * *